US006241465B1

(12) United States Patent
Ulma et al.

(10) Patent No.: US 6,241,465 B1
(45) Date of Patent: Jun. 5, 2001

(54) HOUSING FOR A TURBOMACHINE

(75) Inventors: Andreas Ulma, Mülheim A.D. Ruhr; Ralf Kuhn, Düsseldorf; Max Wiesenberger, Mülheim A.D. Ruhr, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/535,706

(22) Filed: Mar. 27, 2000

Related U.S. Application Data

(63) Continuation of application No. PCT/DE98/02703, filed on Sep. 11, 1998.

(30) Foreign Application Priority Data

Sep. 26, 1997 (DE) ..... 197 42 621
Jul. 29, 1998 (DE) ..... 198 34 221

(51) Int. Cl.[7] ..... F01D 11/00
(52) U.S. Cl. ..... 415/112; 415/174.5; 415/230
(58) Field of Search ..... 415/110, 111, 415/112, 230, 174.5

(56) References Cited

U.S. PATENT DOCUMENTS 3,594,094 * 7/1971 Engelke et al. ..... 415/111
3,754,833 * 8/1973 Remberg ..... 415/108
4,170,364 * 10/1979 Remberg et al. ..... 277/53
5,392,605 2/1995 Kaplan .
6,010,302 * 1/2000 Oeynhausen ..... 415/115

FOREIGN PATENT DOCUMENTS 576 969 5/1933 (DE) .
18 17 012 8/1969 (DE) .
2 411 243 9/1974 (DE) .
43 13 805 A1 11/1994 (DE) .
34 46 385 C2 7/1996 (DE) .
196 15 011 A1 1/1997 (DE) .

OTHER PUBLICATIONS

International Application No. WO 97/04218 (Oyenhausen), dated Feb. 6, 1997, as mentioned on p. 1 of the specification.

* cited by examiner

*Primary Examiner*—Edward K. Look
*Assistant Examiner*—Ninh Nguyen
(74) *Attorney, Agent, or Firm*—Herbert L. Lerner; Laurence A. Greenberg; Werner H. Stemer

(57) ABSTRACT

In a machine having a shaft with a shaft axis, an outer region, and a shaft seal, a component is provided for the shaft seal. The component has a cast part formed of a first metallic material directed along the shaft axis and has an inner wall shaped, at least in regions, in a circumferential direction relative to the shaft axis, and an outer wall directed towards the outer region. A fluid guide is disposed and formed in the cast part and runs in the circumferential direction, at least in regions, and opens into the inner wall. At least one fluid conduit formed of a second metallic material fluidically connects the inner wall to the outer region. The fluid conduit is also fluidically connected to the fluid guide.

21 Claims, 8 Drawing Sheets

HOUSING FOR A TURBOMACHINE

CROSS-REFERENCE TO RELATED APPLICATION

This is a continuation of copending International Application PCT/DE98/02703, filed Sep. 11, 1998, which designated the United States.

BACKGROUND OF THE INVENTION

Field of the Invention

The invention relates to a component, in particular for a shaft seal of a turbomachine, the component has a cast part formed of a first metallic material. The cast part is directed along a shaft axis and has an inner wall shaped, at least in regions, in the circumferential direction relative to the shaft axis, and an outer wall facing an outer region. The component further has a fluid conduit formed of a second metallic material.

International Patent Application WO 97/04218 A1 describes a component for an exhaust-steam connection piece of a turbomachine, in particular of a steam turbine, and for a turbomachine bearing disposed in the exhaust-steam connection piece. The component is cast in one piece and has a connection piece part and/or a bearing part for receiving the bearing as well as a carrying configuration with at least one carrying arm. The component has a pipeline that leads through a connection piece part, a carrying arm and a bearing part and which is cast into the component. The component is formed of a cast iron material, preferably of spheroidal cast iron. The pipeline is preferably manufactured from steel. In this case, the pipeline described may be a simple pipeline formed of an individual pipe or be an insulating pipeline located in a carrying arm and formed of an outer pipe and of an inner pipe laid in the outer pipe and insulated from the latter. An insulating pipeline serves for supplying a hot fluid to a shaft seal or for discharging a hot fluid from the shaft seal. Such a hot fluid is, for example, steam, which is supplied to the bearing for sealing-off purposes, or vapor, that is to say steam which leaks out of the bearing, is possibly contaminated by air and/or oil vapor and has to be discharged. The configuration of the component according to the International Patent Application WO 97/04218 A1 pursues the aim of providing, at as little outlay as possible, a component which, in terms of the delivery and discharge conduits necessary for supplying the bearing, utilizes the available space as well as possible, so as to impair the flow of the flow medium of the turbomachine as little as possible. U.S. Pat. No. 5,392,605 describes a method and a device for reducing the pressure of a combustible gas which is under high pressure. In this case, the device has a seal for a shaft, there being provided in the seal an annular groove which is connected to the surroundings and by which the combustible gas can be discharged. Furthermore, connected to the seal is a region of space which surrounds the shaft and into which air or an inert gas can be supplied.

Published, Non-Prosecuted German Patent Application DE 18 17 012 A specifies a shaft-seal configuration for a machine operating with an elastic fluid and having a plurality of diaphragm seals. In this case, the shaft seal has a delivery conduit for sealing steam which can be removed at a point located upstream of the conventional throttle and shut-off valves for a high-pressure steam turbine.

SUMMARY OF THE INVENTION

It is accordingly an object of the invention to provide a housing for a turbomachine which overcomes the above-mentioned disadvantages of the prior art devices of this general type, through which component fluid can be conveyed from an outer region to an inner wall, or vice versa.

With the foregoing and other objects in view there is provided, in accordance with the invention, in a machine having a shaft with a shaft axis, an outer region, and a shaft seal, a component for the shaft seal including:

a cast part formed of a first metallic material directed along the shaft axis and having an inner wall shaped, at least in regions, in a circumferential direction relative to the shaft axis, and an outer wall directed towards the outer region;

a fluid guide disposed and formed in the cast part and running in the circumferential direction, at least in regions, and opens into the inner wall; and at least one fluid conduit formed of a second metallic material and fluidically connecting the inner wall to the outer region, the fluid conduit also fluidically connected to the fluid guide.

For the component mentioned in the introduction, the object is achieved, according to the invention, by providing, in the first part, a fluid guide which runs in the circumferential direction, at least in regions, and which is opened to the inner wall and is fluidically connected to the fluid conduit, the fluid conduit connecting the inner wall fluidically to the outer region. The fluid conduit is preferably cast into the first part.

In this case, the fluid guide can be connected to the inner wall via a plurality of orifices or, in particular, a slot, and, in particular, the fluid guide itself can be configured so as to be slot-like or groove-like, for example as an annular chamber. In this case, the fluid guide is produced preferably mechanically, for example by milling, lathe-turning or erosion, and, if appropriate, chemically, for example by etching, in the first material. By use of the fluid guide that is provided in the circumferential direction, at least in regions, and which makes a fluidic connection to the inner wall, part of an annular chamber, which communicates with the outer region for the supply and discharge of fluid, is formed in a simple way. The fluid guide led in the circumferential direction forms preferably a half-ring, a complete ring which surrounds the shaft being formed by joining together two components surrounding the shaft.

By the fluid guide being produced in the first part formed of the first material mechanically or chemically, the fluid guide is directly connected fluidically to a cast-in fluid conduit. The fluid conduit may therefore be produced in a geometrically simple way, and in one piece, without welding joints. The risk of the possible penetration of casting material into the fluid conduit when the latter is being cast into the first metallic part is kept low by using a fluid conduit, in particular a pipe, which has no weld seams. Using the fluid guide makes it possible to employ suitably bent fluid conduits, in particular pipes, which serve merely for inflow and outflow and are produced without any weld seams. In this case, one or two or more fluid conduits may be used, depending on the flow cross-section required. The fluidic connection to the fluid conduits is made directly as a consequence of the production of the fluid guide, after the first metallic material has been cast.

Preferably, the fluid conduit projects from the outer wall into the outer region. This act of projecting from the outer wall affords a simple possibility of connecting the fluid conduit, outside the component, to a delivery or discharge system for a fluid. For this purpose, the second material is preferably easily weldable, in particular a steel, so that a leak-tight connection can be made in a simple way by welding the fluid conduit to a discharge or delivery system.

The fluid conduit may also have, outside the component, a flange or the like for a leak-tight connection. This results in considerable cost savings, particularly by dispensing with mechanical machining for pipeline connections, since it is possible to weld directly to the cast-in fluid conduit, for example in the form of a pipe. Casting the fluid conduit formed of the second metallic material into the first metallic part formed essentially of spheroidal graphite iron (also referred to as spheroidal cast iron) makes it possible to effect the supply of fluid from the outer region to the inner wall, and vice versa, in a simple way. In particular, the problem of welding pipelines to spheroidal cast iron which sometimes has insufficient strength is thereby avoided. By spheroidal cast iron it is meant, in this case, a cast iron material that is distinguished, in the solid state, by approximately spherical graphite separations in a metallic matrix. It therefore differs from conventional cast iron which has flake-like separations of graphite. Spheroidal cast iron is distinguished, inter alia, by its good castability. Spheroidal cast iron can be machined by cutting at little outlay, so that contact faces of a component with other components can be executed with predetermined dimensional accuracy. The second material to be cast into the first material is preferably a steel, that is to say an iron material which is distinguished, as compared with a cast iron material, by a markedly lower content of carbon and, linked to this, markedly higher ductility and a substantially higher melting point. In general, a steel melts only at a temperature which is 200° C. higher than a cast iron material. This results in that the steel pipe does not melt when it is cast into a component, that is to say is installed in the mold provided for casting the component and is surrounded by the liquid cast iron material. Possibly impaired dimensional stability due to the nevertheless very high temperature to which the pipe is exposed may be prevented by filling the pipe with sand or another suitable filler, in particular a filler which is capable of being melted later. Depending on the instance in which the component is used, specific elements may be alloyed in light of the intended purpose of the cast iron material and the steel. For example, steel known as ST37 may be considered as the weldable steel.

The fluid conduit (the conduit segment) and/or the fluid guide are/is preferably a pipe and, furthermore, preferably has a wall thickness of more than 5 mm, in particular between 8 mm and 12 mm. Before the fluid conduit is cast into the component, the latter may have on its outer surface ribs or similar elevations which, on contact with the hot melted cast iron material, melt down or on and thereby ensure that the fluid conduit is well connected to and sealed off from the cast first material. The ribs may have a height of, for example, 20 mm.

The component is preferably an integral part of a semi-monocoque turbine casing, in particular the outer casing of a steam turbine. After the turbine casing has been assembled, the component surrounds the turbine shaft in the region of the shaft seal. Preferably, the component functions as a fluid-conduit system, which contains the fluid guide and the fluid conduit, serving for the discharge of vapor and a further fluid-conduit system serving for the supply of sealing steam. A pressure of about 1.05 bar (a slight overpressure) is set in the fluid-conduit system for the supply of sealing steam and a slight underpressure of about 1.0 bar is set in the fluid-conduit system for the suction-extraction of vapor. Leak-tightness of the shaft seal and the suction-extraction of vapor are thereby ensured.

The fluid conduit is preferably a simple pipeline for transporting of a fluid. The fluid may have a temperature that approximately coincides with the temperature of the fluid flowing through the turbomachine, so that, at most, insignificant thermal stresses may be expected due to temperature differences between the fluids.

Preferably, for the component mentioned in the introduction, a fluid-conduit system is provided, having a fluid guide and a fluid conduit, the latter also referred to as a conduit segment, which connects the inner wall fluidically to the outer wall. The fluid guide is directed in the circumferential direction, at least in regions, and has at least one orifice, in particular a slot, for making a fluidic connection to the inner wall.

The slot is produced mechanically, for example by a lathe-turning or circular milling, preferably after casting. The fluid guide is configured preferably as a pipe. It is formed preferably by a material that is different from the first material and, depending on requirements, may be identical to the second material for the fluid conduit. The fluid guide is preferably cast in the first material.

The fluid guide, which extends in the circumferential direction and which makes a fluidic connection to the inner wall, forms, in a simple way, part of an annular chamber which requires no further mechanical machining. As compared with previous practice, it is possible for, in particular, annular chambers for the shaft-sealing system to be either cast directly into the casing surrounding the shaft or machined mechanically, and the component having the fluid guides directed in the circumferential direction as a greatly simplified configuration. This is also true in comparison with chambers that are produced by installing rings or bushes. The fluid guide led in the circumferential direction preferably forms a half-ring, a complete ring which surrounds the shaft being formed by joining together two components surrounding a shaft.

Other features which are considered as characteristic for the invention are set forth in the appended claims.

Although the invention is illustrated and described herein as embodied in a housing for a turbomachine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
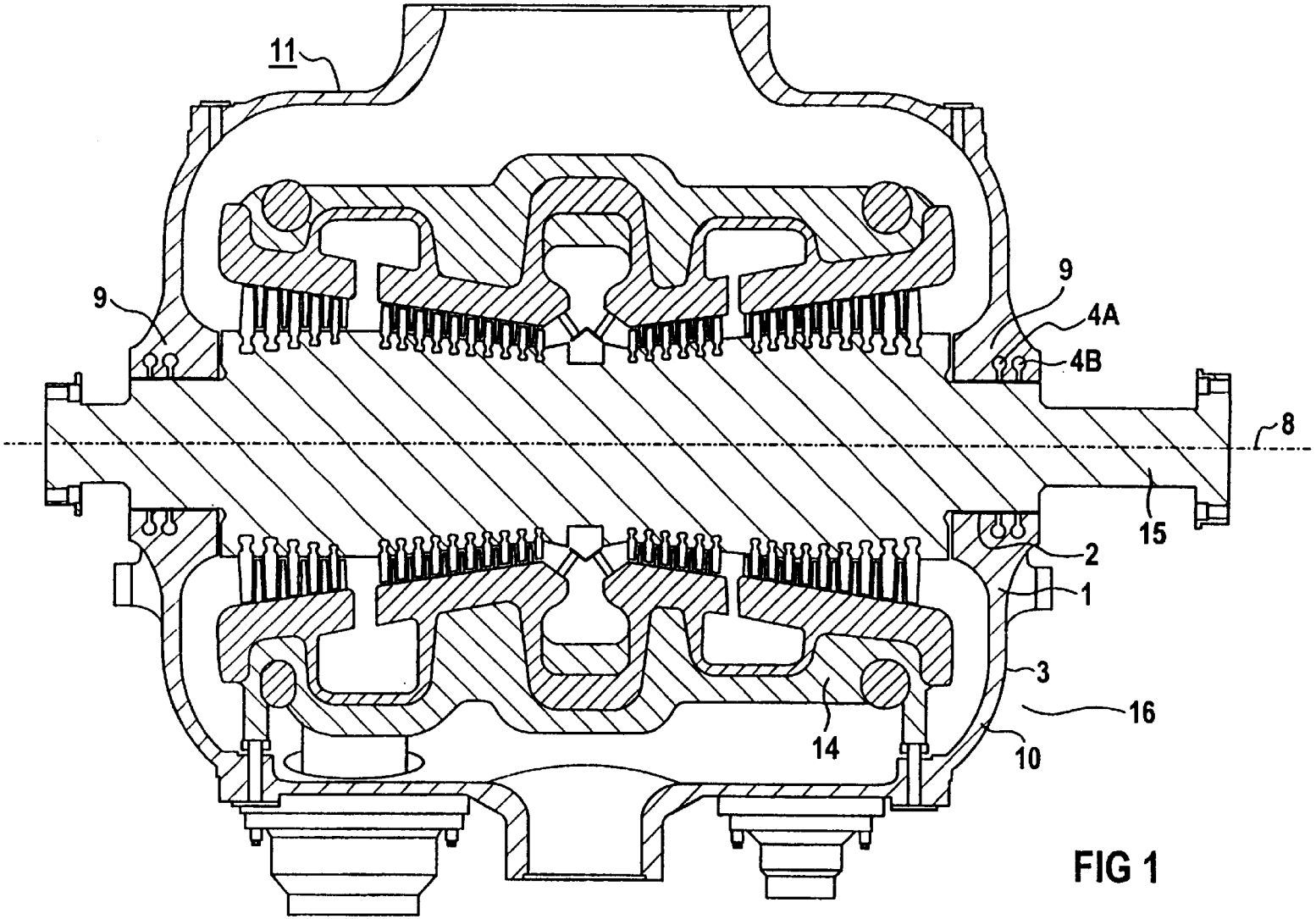
FIG. 1 is a diagrammatic, longitudinal sectional view through a medium-pressure part steam turbine according to the invention.

In all the figures of the drawing, sub-features and integral parts that correspond to one another bear the same reference symbol in each case. Referring now to the figures of the drawings in detail and first, particularly, to FIG. 1 thereof, there is shown a turbomachine 11, in particular a medium-pressure part steam turbine 11. The steam turbine 11 has a turbine shaft 15 directed along a shaft axis 8, an inner casing 14 surrounding the turbine shaft 15, and a turbine casing 10 (outer casing) surrounding the inner casing 14. The steam turbine 11 is of the double-flow type and has corresponding configurations, known to the specialists, as regards a steam inlet, a steam outlet, turbine guide blades and turbine moving blades, which will not be dealt with in any more detail here. At two ends located opposite one another along the shaft axis 8, the turbine casing 10, which is composed of two halves, has a shaft seal 9 and a component 1 for the supply of sealing steam and the discharge of vapor. The component 1, which is an integral part of the cast turbine casing 10, has an inner wall 2, bearing on the turbine shaft 15, and an outer wall 3, adjoining an outer region 16 surrounding the outer casing 10. Furthermore, the component 1 has two fluid guides 4A, 4B which are configured as semi-annular chambers, are at an axial distance from one another and are each configured as a semi-annular groove (see FIGS. 2 and 3 according to a first embodiment and FIGS. 5 to 8 according to a second embodiment). According to the first embodiment, each of the fluid guides 4A, 4B are opened to the inner wall 2 in a slot-like manner towards the turbine shaft 15. Each of the fluid guides 4A, 4B is subsequently produced mechanically, for example by lathe-turning or circular milling, preferably after the casting of the component 1. Sealing steam can be supplied between the turbine casing 10 and the turbine shaft 15 in the region of the shaft sealing 9 by the fluid guide 4A. For this purpose, the fluid guide 4A is connected fluidically to two fluid conduits 5 that project into the outer region 16 (see FIGS. 2 and 3). Vapor can be suction-extracted by the fluid guide 4B. In this case, the fluid guide 4B is connected fluidically to the outer region 16 via a further fluid conduit 6 (see FIGS. 2 and 3). Each of the fluid guides 4A, 4B forms, with the fluidically connected fluid conduit 5, 6, a fluid-conduit system respectively for discharging and supplying fluid from the outer region 16 towards the turbine shaft 15.

Figure 5:
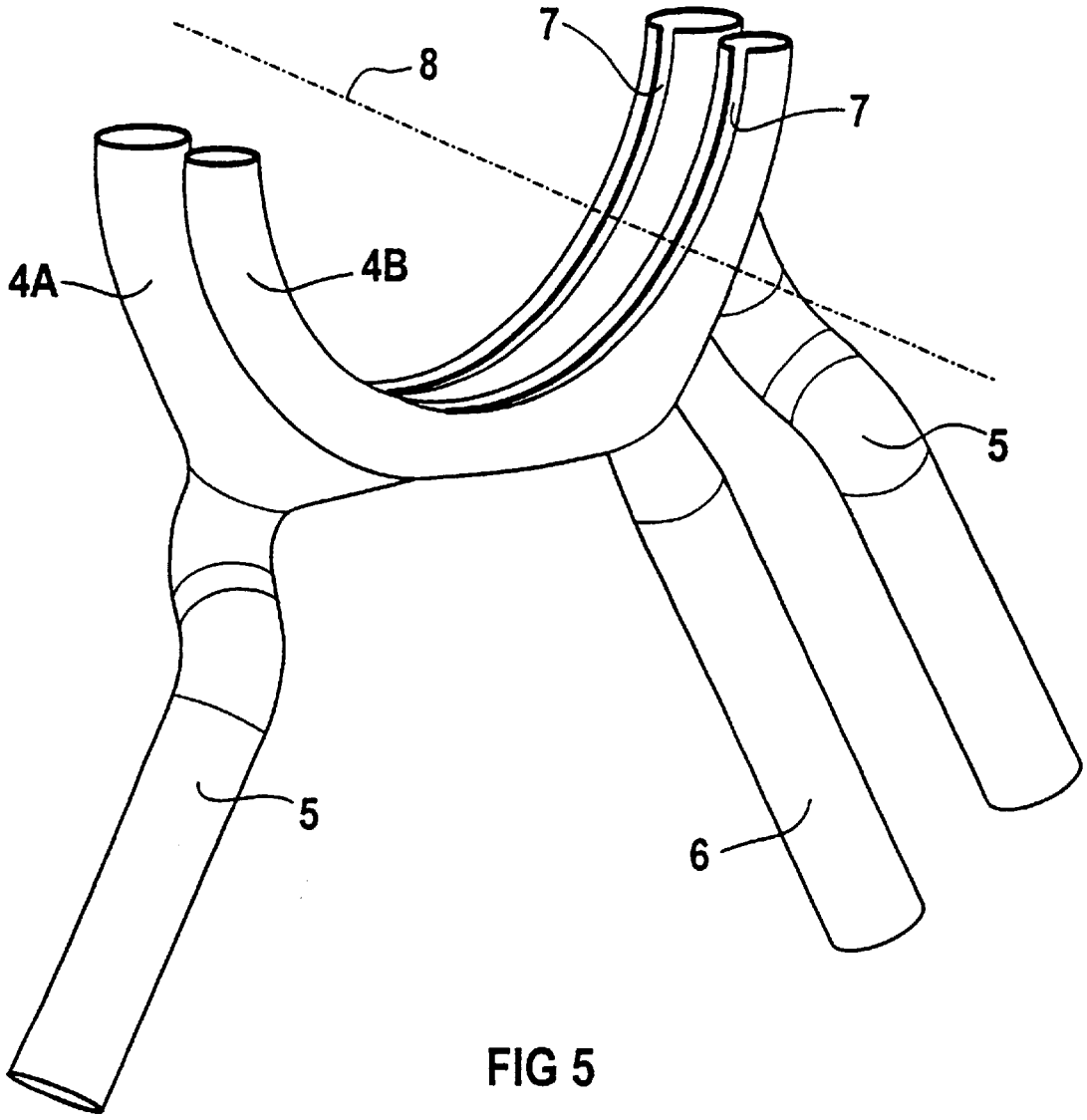
FIG. 5 is a perspective view of the configuration with two fluid-conduit systems.

Furthermore, according to a second embodiment, the component 1 has two fluid-conduit systems which are at an axial distance from one another and the fluid guides 4A, 4B are semi-annular fluid guides 4A, 4B (see FIG. 5). The annularly configured fluid guide 4A, 4B has a slot 7 facing the turbine shaft 15 and running in the circumferential direction. The slot 7 is produced mechanically, preferably after casting. Sealing steam can be supplied between the turbine casing 10 and the turbine shaft 15 in the region of the shaft seal 9 through the slot 7 of one fluid-conduit system 4A, 5. Vapor can be suction-extracted through the slot 7 of the other fluid-conduit system 4B, 6.

Figure 2:
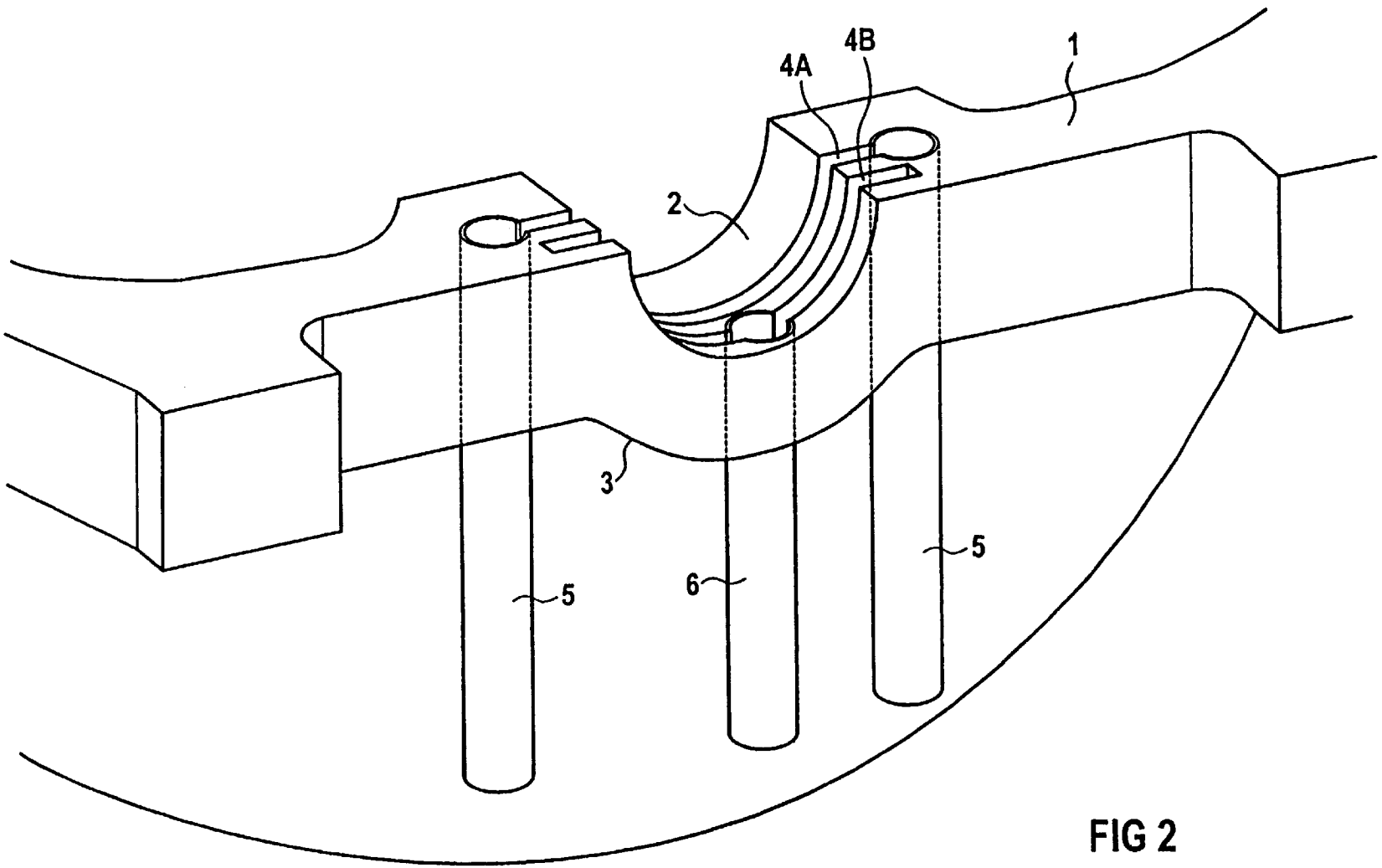
FIGS. 2 and 3 are fragmented, perspective views, in each case, of a configuration with two fluid guides and associated fluid conduits.
Figure 3:
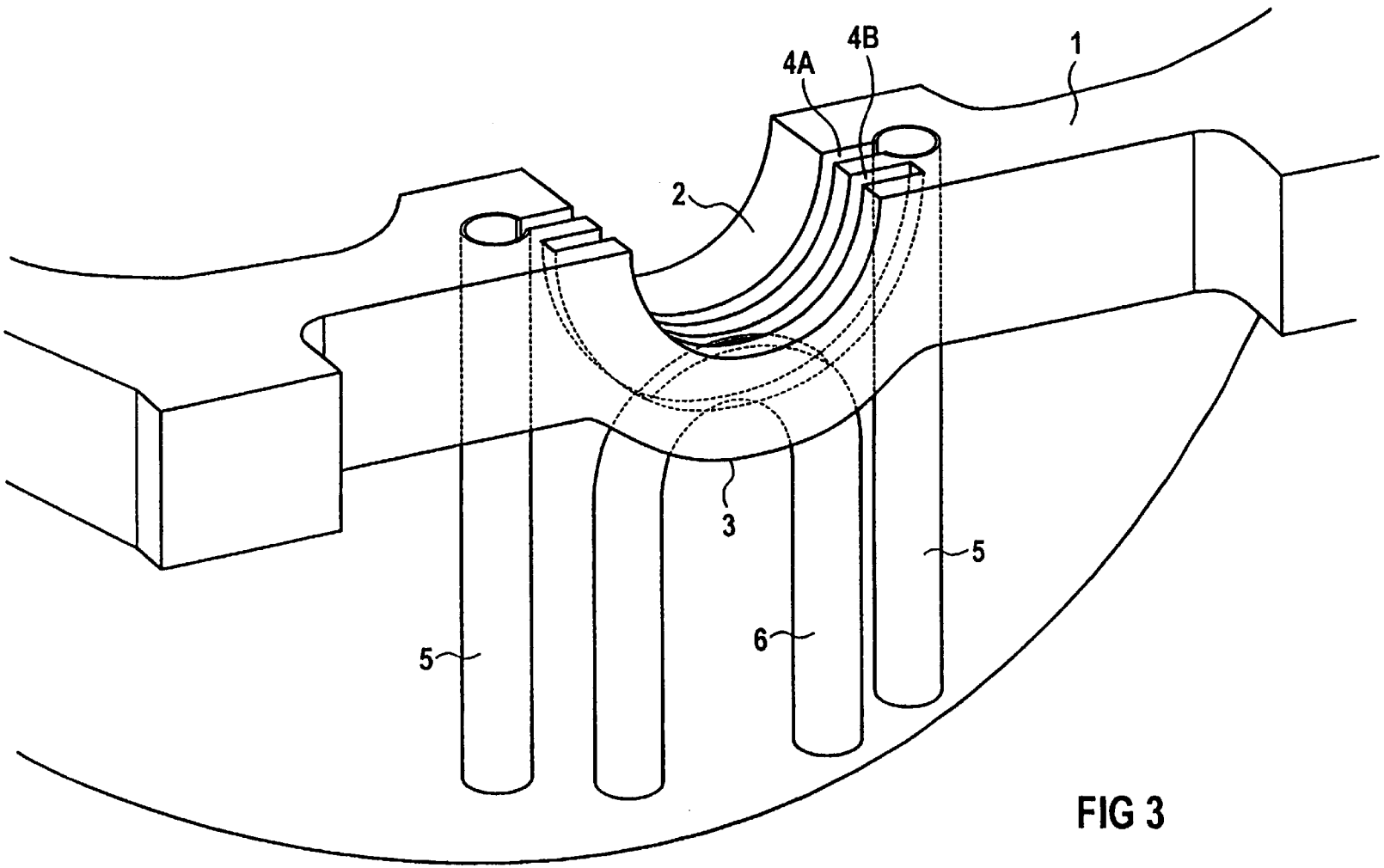

FIG. 2 shows, in each case in a three-dimensional illustration, the fluid-conduit system, consisting of the fluid guide 4A and the fluid conduits 5, for the supply and discharge of the sealing steam and the fluid-conduit system, containing the fluid guide 4B and the fluid conduit 6, for the discharge of the vapor, and how the systems are cast into the component 1 of one half of a longitudinally divided turbine casing 10. The fluid conduits 5 and 6 are directed radially outwards and project from the component 1 to such an extent that a welded connection to a delivery or discharge system (not illustrated) can be made in a simple way. The semi-annular fluid guides 4A, 4B configured as grooves are opened to the turbine shaft 15 in a slot-like manner. The fluid conduit 6 is disposed between the fluid conduits 5. The fluid conduits 5 are connected fluidically to the fluid guide 4A in the region of the parting plane, not illustrated in any more detail, between the two halves of the turbine casing 10. The fluid conduit 6 is fluidically connected to the fluid guide 4B in the geodetically lowest region of the latter; it thereby becomes easier for the vapor to be discharged. The fluid conduits 5 are configured in each case as pipes free of weld seams. The same is true of the fluid conduit 6 which, according to FIG. 2, is configured as a straight pipe and, according to FIG. 3, as a U-shaped pipe, the fluidic connection to the fluid guide 4B being made in the vertex region of the U-shaped pipe by slotting.

Figure 4:
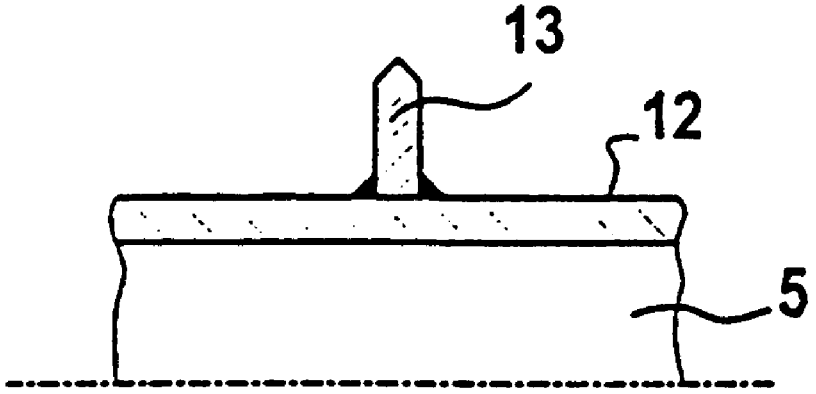
FIG. 4 is a fragmented, longitudinal sectional view through a fluid conduit.

FIG. 4 illustrates a detail of the fluid conduit 5 in longitudinal section. The fluid conduit 5 is configured as a simple pipeline piece which has a welded-on ring 13 (rib 13) in the circumferential direction on its outer surface 12. The ring 13 has a peripheral tip that fuses with the first metallic material, to be cast, of the component 1. The fluid conduit 6 may have a similar configuration.

When the component 1 is being produced, the fluid conduits 5, 6, which consists preferably of steel, are cast in by being installed in the associated casting mold before the casting of the component 1 and by being encased in the cast iron material during casting. Since the melting point of steel is usually well above the melting point of a cast iron material, the fluid conduits 5, 6 do not melt during this procedure. In order to prevent them from being bent out of shape or being otherwise deformed, they are filled, before casting, with a suitable filler, in particular sand, and fixed in a core box. All known molding and casting methods are available for casting the component 1 that is an integral part of the turbine casing 10. The most cost-effective and, therefore, the preferred casting method is sand casting, that is to say the casting mold is filled with sand and the cast iron material is cast into the casting mold thus formed.

After the fluid conduits 5, 6 have been cast in, semi-circular grooves (fluid guides 4A, 4B) are made in the component 1 mechanically or chemically and are in each case connected to at least one fluid conduit 5 or one fluid conduit 6.

FIG. 5 shows, in a three-dimensional illustration, the fluid-conduit system 4A, 5 for the supply and discharge of the sealing steam and the fluid-conduit system 4B, 6 for the discharge of vapor, and how the systems are cast into the component 1 of one half of a longitudinally divided turbine casing 10. Each of the fluid-conduit systems consists of the semi-annular fluid guide 4A, 4B, to which the conduit segment 5 (fluid-conduit system for vapor) and/or two conduit segments 6 (fluid-conduit system for sealing steam) is/are connected. The conduit segments 5 and 6 are in each case directed radially outwards and project from the component 1 to such an extent that a welded connection to a delivery or discharge system, (not illustrated), can be made in a simple way. The semi-annular fluid guides 4A, 4B each have, in the circumferential direction, the slot 7 which is assigned to the turbine shaft 15 (see FIG. 1).

Figure 6:
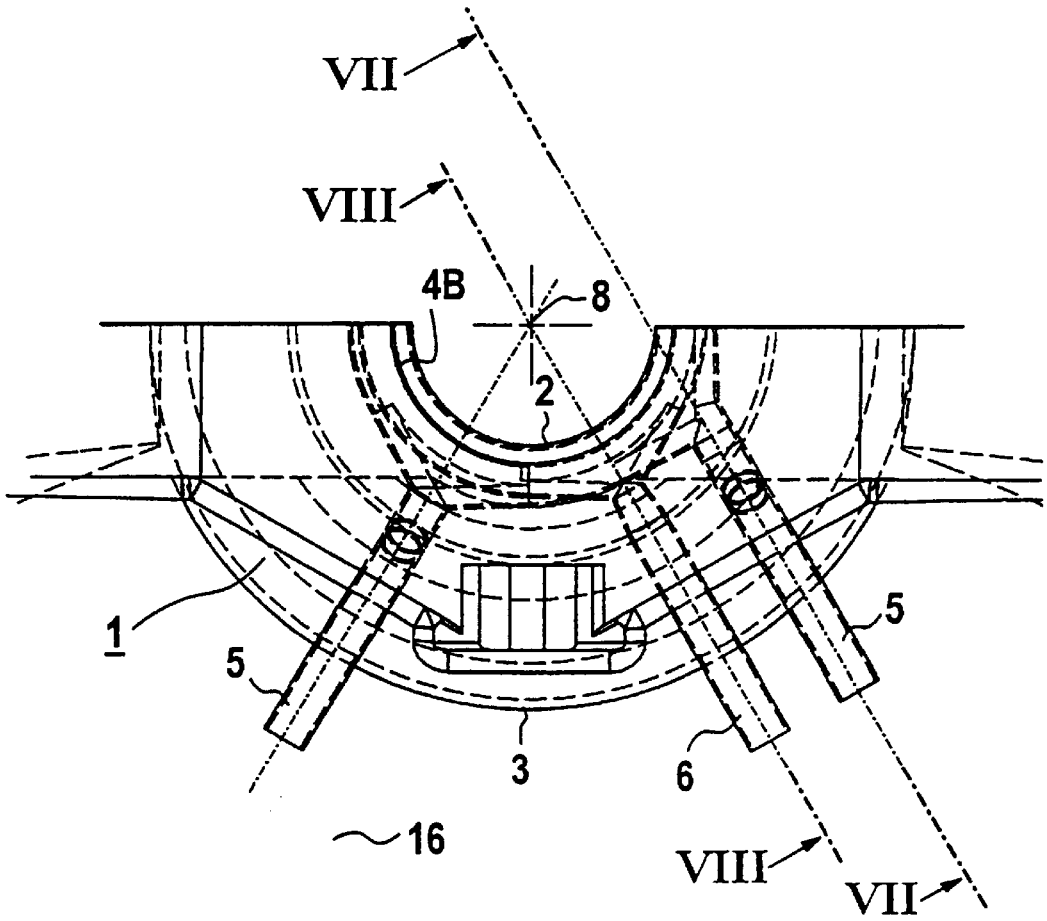
FIG. 6 is a sectional view, perpendicular to a shaft axis, through the steam turbine similar to that of FIG. 1, FIGS. 7 and 8 are fragmented, sectional views along the shaft axis through the fluid-conduit system according to FIG. 5.

FIG. 6 shows, in the axial direction, a multi-layered section through the fluid-conduit systems 4A, 5; 4B, 6 according to FIG. 5, specifically for a lower half of the turbine casing 10. The conduit segments 5, 6 are each inclined at an acute angle to the vertical.

Figure 7:
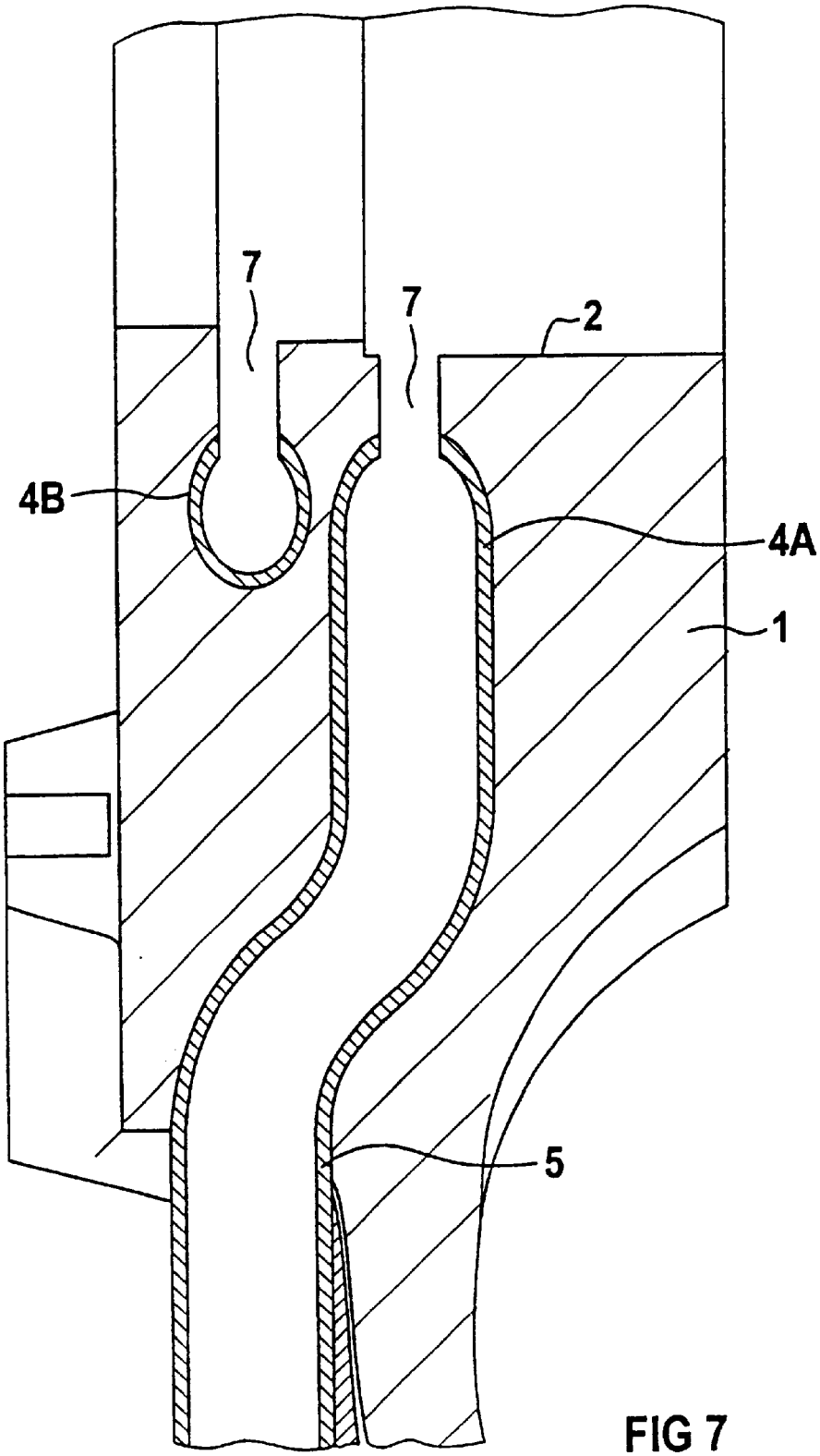

FIG. 7 illustrates a section through the component 1, parallel to the shaft axis 8, through the fluid-conduit system 4A, 5 for the delivery of the sealing steam. The conduit segment 5 projecting from the component 1 is led, slightly curved, so that it emerges from the component 1 in the same plane perpendicular to the shaft axis 8 as the conduit segment 6 of the fluid-conduit system for the vapor. It can also be seen clearly that the fluid guide 4A of the fluid-conduit system for the vapor forms an annular chamber which has a circular cross-section and which is connected to the inner wall 2 via an orifice 7, the slot.

Figure 8:
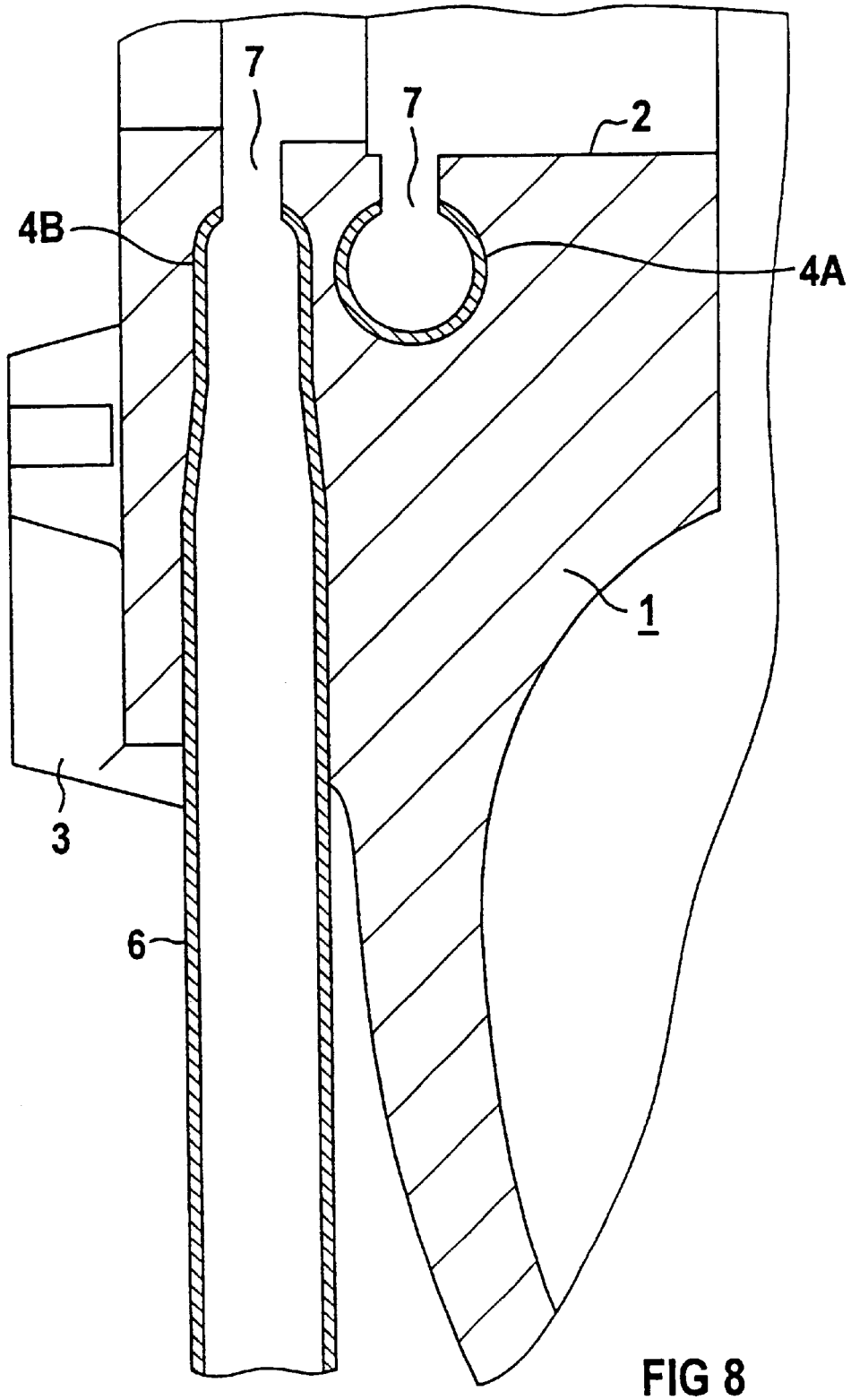

Similarly, FIG. 8 shows a section through the fluid-conduit system for the vapor, having the conduit segment 6. Here too, it can be seen that the fluid-conduit system forms a chamber of circular cross-section by the fluid guide 4A. The conduit segments 5 and 6 and the fluid guides 4A, 4B may have a diameter of more than 10 cm.

The fluid guides 4A, 4B and the conduit segments 5, 6 consist preferably of steel. They are cast in, as already stated above.

The invention is distinguished by the fluid-conduit system in the component, in particular for the shaft seal, in which is provided the fluid guide curved in the circumferential direction which is opened towards the turbine shaft. Provided on the fluid guide is the fluid conduit which is directed preferably in the radial direction and which projects from the component and consists, at least there, of an easily weldable material, in particular steel. A firm and leak-tight connection to a delivery or discharge system can thereby be achieved by welding. The fluid conduit is preferably free of weld seams, so that casting materials is prevented from penetrating into the fluid conduit as a result of weld seams. Preferably, the component is used in a steam turbine for the supply of sealing steam and for the discharge of vapor. Other fields of use may be, in general, rotary machines with shaft seals, such as, for example, generators and pumps.

We claim:

1. In a machine having a shaft with a shaft axis, an outer region, and a shaft seal, a component for the shaft seal comprising:

a cast part formed of a first metallic material directed along the shaft axis and having an inner wall shaped, at least in regions, in a circumferential direction relative to the shaft axis, and an outer wall directed towards the outer region;

a fluid guide disposed and formed in said cast part and running in the circumferential direction, at least in regions, and opens into said inner wall; and at least one fluid conduit formed of a second metallic material and fluidically connecting said inner wall to the outer region, said fluid conduit also fluidically connected to said fluid guide.

2. The component according to claim 1, wherein said fluid conduit is cast into said cast part formed of said first metallic material.

3. The component according to claim 1, wherein said fluid guide is formed of a further material.

4. The component according to claim 3, wherein said further material is said second metallic material.

5. The component according to claim 3, wherein said fluid guide is an integral part of said cast part and is formed along with said cast part.

6. The component according to claim 1, wherein said fluid guide is pipe-shaped.

7. The component according to claim 1, wherein said fluid guide has a slot formed therein opening into said inner wall.

8. The component according to claim 1, wherein said fluid guide is formed in said cast part by at least one of mechanical and chemical forming.

9. The component according to claim 1, wherein said fluid guide is a groove formed in said cast part.

10. The component according to claim 1, wherein said fluid guide is an annular chamber formed in said cast part.

11. The component according to claim 1, wherein said fluid guide is two fluid guides connected in each case to said at least one fluid conduit.

12. The component according to claim 1, wherein said first metallic material is a spheroidal cast iron substantially containing iron.

13. The component according to claim 1, wherein said second metallic material is weldable.

14. The component according to claim 13, wherein said second metallic material is steel.

15. The component according to claim 1, wherein said fluid conduit is a pipe.

16. The component according to claim 1, wherein at least one of said conduit and said fluid guide has a wall thickness of more than 5 mm.

17. The component according to claim 1, wherein at least one of said conduit and said fluid guide has a wall thickness of between 8 mm and 12 mm.

18. The component according to claim 1, wherein the machine has a semi-monocoque turbine casing connected to said outer wall.

19. The component according to claim 1, wherein the machine is a steam turbine and said at least one fluid conduit includes a first fluid conduit serving for discharging vapor and a second fluid conduit serving for supplying sealing steam.

20. The component according to claim 1, wherein at least one of said fluid conduit and said fluid guide is formed as a pipe having an outer surface with a rib disposed on said outer surface.

21. The component according to claim 1, wherein the machine is a turbomachine.

* * * * *